US011486200B2

(12) United States Patent
Toustrup et al.

(10) Patent No.: US 11,486,200 B2
(45) Date of Patent: Nov. 1, 2022

(54) ESCAPE SYSTEM COMPRISING EXTENDIBLE LADDER

(71) Applicant: Klejngaard Safety ApS, Copenhagen K (DK)

(72) Inventors: Sofie Klejnstrup Toustrup, Copenhagen Ø (DK); Lisa Ruegaard Petersen, Charlottenlund (DK)

(73) Assignee: Klejngaard Safety ApS, Copenhagen K (DK)

( * ) Notice: Subject to any disclaimer, the term of this patent is extended or adjusted under 35 U.S.C. 154(b) by 84 days.

(21) Appl. No.: 16/768,445

(22) PCT Filed: Nov. 30, 2018

(86) PCT No.: PCT/EP2018/083189
§ 371 (c)(1),
(2) Date: May 29, 2020

(87) PCT Pub. No.: WO2019/106168
PCT Pub. Date: Jun. 6, 2019

(65) Prior Publication Data

US 2020/0386051 A1 Dec. 10, 2020

(30) Foreign Application Priority Data

Dec. 1, 2017 (DK) ..... PA 2017 70899

(51) Int. Cl.
*E06C 9/08* (2006.01)

(52) U.S. Cl.
CPC ..... *E06C 9/08* (2013.01)

(58) Field of Classification Search
CPC ..... E06C 9/08; E06C 9/06; E06C 9/00; E06C 9/12; E06C 9/10; E06C 9/085; E06C 1/08;

(Continued)

(56) References Cited

U.S. PATENT DOCUMENTS 389,696 A * 9/1888 Fink ..... E06C 9/08 182/95
516,528 A * 3/1894 Goldberg ..... E06C 9/08 182/208

(Continued)

FOREIGN PATENT DOCUMENTS

DE 3047460 7/1982
DK 201770899 6/2019

(Continued)

*Primary Examiner* — Daniel P Cahn
*Assistant Examiner* — Shiref M Mekhaeil
(74) *Attorney, Agent, or Firm* — McHale & Slavin, P.A.

(57) ABSTRACT

An escape system for providing an escape route out of a building is discloses. The system comprises a ladder, and at least one anchor element at a position distant from the proximal end of the ladder. The ladder is extendible between a collapsed storage configuration and an extended use configuration. The ladder comprises a plurality of essentially rigid ladder segments, each ladder segment comprising at least one rung and being displaceable in relation to the remaining plurality of ladder segments. The ladder also comprises at least one fixation element attached to or forming part of at least one of the ladder segments. The fixation element comprises a first spacer element, the first spacer element extending between the anchor element and the ladder in the extended use configuration. The ladder is detached from the anchor element in the collapsed storage configuration, and at least one fixation element of the ladder is configured to attach to the anchor element when the ladder is in the extended use configuration.

13 Claims, 7 Drawing Sheets

(58) Field of Classification Search
CPC ... E06C 1/10; E06C 1/12; E06C 1/383; E06C 7/48; E06C 7/182
USPC ..... 182/93
See application file for complete search history.

(56) References Cited

U.S. PATENT DOCUMENTS 1,065,166 A * 6/1913 Murphy ..... E06C 9/14 182/95
1,813,865 A 7/1931 Reese
2,513,835 A * 7/1950 Allen ..... E06C 9/08 182/195
2,836,336 A * 5/1958 Hansen ..... E06C 9/08 182/208
3,059,721 A * 10/1962 Straw ..... E06C 1/34 182/13
3,575,263 A * 4/1971 Reinhard ..... E06C 9/085 182/160
3,858,683 A * 1/1975 Rachocki ..... E06C 7/08 182/206
3,871,479 A * 3/1975 Pelto ..... A62B 5/00 182/86
3,963,097 A 6/1976 Fisher
3,997,026 A * 12/1976 Riehlmann ..... E06C 9/08 182/195
4,002,223 A * 1/1977 Bernkrant ..... B63B 27/14 182/228.1
4,037,686 A * 7/1977 Shull ..... E06C 9/085 182/160
4,189,028 A * 2/1980 Reinhard ..... E06C 9/085 182/160
4,232,761 A * 11/1980 Phillips ..... E06C 1/125 182/208
4,815,561 A * 3/1989 Ostrander ..... E06C 9/10 182/95
5,018,600 A * 5/1991 Sobczak ..... E06C 9/14 182/198
5,022,491 A * 6/1991 Gill ..... E06C 9/14 182/95
5,303,799 A * 4/1994 Tsai ..... E06C 9/10 182/74
5,605,203 A * 2/1997 Chang ..... E06C 9/14 182/95
5,875,870 A * 3/1999 Lee ..... A62B 5/00 182/74
6,345,691 B1 * 2/2002 Ruiz ..... B63B 27/146 182/127
8,028,804 B2 * 10/2011 Lair ..... E06C 1/12 182/78
9,108,071 B2 * 8/2015 Conde, Jr. ..... A62B 1/00
9,994,159 B2 * 6/2018 Giesmann ..... B60R 3/02
10,208,539 B2 * 2/2019 Beard ..... E04F 11/068
10,731,414 B2 * 8/2020 Junghans ..... F15B 1/04

FOREIGN PATENT DOCUMENTS

GB 1265436 3/1972
GB 2291922 2/1996
KR 101166319 7/2012
SU 703036 12/1979
SU 1682511 10/1991
WO WO2004067895 8/2004

* cited by examiner

ESCAPE SYSTEM COMPRISING EXTENDIBLE LADDER

CROSS REFERENCE TO RELATED APPLICATIONS

This is a national stage filing in accordance with 35 U.S.C. § 371 of PCT/EP2018/083189, filed Nov. 30, 2018, which claims the benefit of the priority of Denmark Patent Application No. PA 2017 70899, filed Dec. 1, 2017, the contents of each are incorporated herein by reference.

TECHNICAL FIELD

The present invention relates to an escape system comprising an escape ladder for providing an escape route out of a building. The escape ladder comprises a plurality of telescopically displaceable essentially rigid ladder segments.

BACKGROUND OF THE INVENTION

Various escape ladders are known for providing an escape route of a building. In general, an escape ladder may be of a first type or a second type. The first type of ladder is permanently mounted to a building and ready for use with little or no need for extension of the ladder case of an emergency. Often such ladders comprise rigid ladder segments and platforms permanently mounted to the façade of a multi-story building, possibly with the ladder segment closest to ground being an extendible ladder segment aiming to prevent access to the escape ladder from ground. While such ladders often provide relatively high structural stability for a safe descent, the need for relative large structures permanently mounted on the façade of the building may have detrimental effects on the visual expression of the building, which for buildings worth preserving may prevent installation, as well as the possible ineffectiveness of such ladders towards preventing access from ground with negative consequences for theft prevention.

The second type of ladder is an extendible ladder, which is stored in a collapsed or compressed configuration with one end of the ladder being secured to the building. This second type of ladder is then extended when the need for an escape route arises. While such ladders generally have less impact on the visual expression of the building they are mounted on, and commonly provide improved prevention of unwanted ground access as compared to the first type, they may lack in structural stability. Even in the case of a second type of escape ladder being formed by a plurality of mutually displaceable rigid elements, the ladder may lack structural stability.

SUMMARY OF THE INVENTION

In a first aspect, the invention provides an escape system for providing an escape route out of a building, the system comprising a ladder securable at a proximal end thereof to a building, and at least one anchor element at a fixed position relative to the building at a position distant from the proximal end of the ladder, the ladder being extendible between a collapsed storage configuration and an extended use configuration, wherein the ladder comprises:

a plurality of essentially rigid ladder segments, each of the ladder segments comprising at least one rung and being displaceable in relation to the remaining plurality of ladder segments;

a stopping mechanism configured to prevent ladder segments from displacement beyond their extension in the extended use configuration; and at least one fixation element attached to or forming part of at least one of the ladder segments, the fixation element comprising a first spacer element, the first spacer element extending between the anchor element and the ladder in the extended use configuration, wherein the ladder is detached from the anchor element in the collapsed storage configuration, and at least one fixation element of the ladder is configured to attach to the anchor element when the ladder is in the extended use configuration.

In a second aspect, the invention provides an escape ladder for being mounted on a building, the ladder being securable at a proximal end thereof to a building and being extendible between a collapsed storage configuration and an extended use configuration, wherein the ladder comprises:

a plurality of essentially rigid ladder segments, each of the ladder segment comprising at least one rung and being displaceable in relation to the remaining plurality of ladder segments;

a stopping mechanism configured to prevent ladder segments from displacement beyond their extension in the extended use configuration; and at least one fixation element attached to or forming part of at least one of the ladder segments, the fixation element comprising a first spacer element, the first spacer element extending between the building and the ladder in the extended use configuration, wherein at least one fixation element of the ladder is configured to attach to an anchor element when the ladder is in the extended use configuration.

In a third aspect, the invention provides a method of providing an escape route out of a building, the method comprising the steps of:

securing a proximal end of a ladder to at least part of a building, the ladder comprising a plurality of essentially rigid ladder segments, each of the ladder segment comprising at least one rung and being displaceable in relation to the remaining plurality of ladder segments;

the ladder being extendible between a collapsed storage configuration and an extended use configuration; and the ladder comprising at least one fixation element attached to or forming part of at least one of the ladder segments, the fixation element comprising a first spacer element, the first spacer element being configured to extend between the anchor element and the ladder, and to attach to an anchor element in the extended use configuration;

providing a stopping mechanism, which is configured to prevent ladder segments from displacement beyond their extension in the extended use configuration; and securing at least one anchor element at a fixed position relative to the building at a position distant from the proximal end of the ladder.

In a fourth aspect, the invention provides a method of extending an escape ladder of an escape system, the escape ladder being secured at a proximal end thereof to a building, the ladder comprising:

a plurality of essentially rigid ladder segments;

a stopping mechanism; and at least one fixation element attached to or forming part of at least one of the ladder segments, the fixation element comprising a first spacer element, wherein the escape system further comprises at least one anchor element at a fixed position relative to the building at a position distant from the proximal end of the ladder, and wherein the method comprises the steps of:

extending the ladder from a collapsed storage configuration to an extended use configuration by displacing the plurality of essentially rigid ladder segments in relation to each other;

the stopping mechanism preventing ladder segments from displacing beyond their extension in the extended use configuration; and attaching at least one fixation element to the at least one anchor element via the first spacer element.

By the provision of the plurality of essentially rigid displaceable ladder segments and the at least one fixation element of the ladder being configured to attach to an anchor element, the ladder is able to attain improved structural stability in the extended use configuration. The improved structural stability of the ladder works to increase the safety for a person climbing the ladder, as movement of the ladder is reduced. Structural stability may further improve the perceived safety of a person about to climb onto the ladder, and the experienced safety of a person climbing onto the ladder. Accordingly, a person may be more likely to climb onto the ladder and access the escape route than for less mechanically stable ladders. Notably, the improved mechanical stability is attained without requiring the ladder to be permanently mounted in the extended use configuration. The ladder is then allowed to have relatively small structural and visual impact on the building it is installed on. Further, by allowing the ladder to be stored in a configuration wherein it is not reachable from ground, the ladder may provide improved protection against unwarranted access to the ladder as compared to ladders with segments permanently installed near ground.

In embodiments, each of the ladder segments is telescopically displaceable in relation to the remaining plurality of ladder segments. In this case, extending the ladder from the collapsed storage configuration to the extended use configuration comprises telescopically extending the telescopically displaceable latter segments.

In embodiments, the escape system is configured to extend the ladder at shorter distance from the building than the length of the first spacer element. In this case, attachment of the fixation element to the anchor element will push the ladder away from the building. This may increase the reliability of each fixation element attaching to an anchor element.

In embodiments, at least some of the plurality of displaceable rigid ladder segments are displaceable in parallel planes in relation to other ladder segments. In this case, extending the ladder from the collapsed storage configuration to the extended use configuration comprises displacing the latter segments in parallel planes. Adjacent ladder segments may be joined by joints allowing the adjacent ladder segments to slide relative to each other. In one embodiment, adjacent ladder segments overlap at least almost completely in the collapsed storage configuration, and overlap significantly less in the extended use configuration.

In embodiments, at least some of the plurality of displaceable rigid ladder segments are displaceable in a foldable manner in relation to each other. Adjacent ladder segments may be joined by joints with limited rotational freedom allowing adjacent ladder segments to rotate about 180 degrees relative to each other, preferentially in a plane perpendicular to both the longitudinal and transverse extend of the ladder segments.

Further, the attachment between the fixation element and the anchor element may carry part of the load of the ladder and accompanying person(s). This reduces the load on the securement of the proximal end of the ladder to the building and accordingly fewer constraints are put on the proximal securement of the ladder.

Further, thanks to the at least one anchor element being arranged at a position distant from the proximal end of the ladder, the ladder may gain improved mechanical stability in the extended use configuration even when spanning relatively large distances as could be the case for multi-story buildings.

The first spacer element of the at least one fixation element further provides a space between the ladder in the extended use configuration and the building out of which the escape route is provided. In embodiments, this space between the ladder and building is chosen with an aim to enable a person to reach from the building and grab the ladder, while also allowing enough space for a person to fit in the space between the building and ladder so as to climb the ladder with the support of the building behind. In one embodiment, the first spacer element is between 50 cm and 70 cm long, in one embodiment between 55 cm and 65 cm.

In embodiments, the proximal end of the ladder is secured to the building at a proximal end in both the collapsed storage configuration and the extended use configuration. Accordingly, the ladder is already secured to the building before extension to the extended use configuration and there is no need for additional securement of the proximal end of the ladder upon extension of the ladder.

In embodiments, the ladder in the collapsed storage configuration is stored in a housing protecting the ladder from the elements of the outside. The housing may be configured to automatically open in case of a need for extension of the ladder.

In embodiments, the rigid ladder segments, preferably at least a majority of the elements of the escape system, are made from metal, preferentially steel for increased resilience towards elevated temperatures experienced during a fire.

In embodiments, the fixation element comprises a fixation extension mechanism, the fixation extension mechanism being configured to automatically extend the at least one fixation element towards the anchor element when the ladder is extended from the collapsed storage configuration to the extended use configuration.

This level of automation allows for more rapid and possibly also more secure attachment of the at least one fixation element to the at least one anchor element.

In embodiments, the fixation extension mechanism is configured to automatically extend the at least one fixation element at a first predetermined degree of displacement of adjacent ladder segments. This allows for timing extension of the at least one fixation element with extension of the ladder segments for improved reliability of establishing connection between the fixation element and anchor element.

In embodiments, the fixation extension mechanism comprises a resilient member allowing the fixation element to be resiliently extended towards the anchor element. In this case, if an obstacle initially prevents the fixation element to fully extend towards the anchor element and the obstacle subsequently is removed, the fixation element may then automatically fully extend towards the anchor element due to the resilience of the fixation element mechanism. In one embodiment, the resilience is provided by a spring member comprised in the fixation extension mechanism, the spring member preferentially being made from steel.

The fixation element may be configured to automatically attach to the anchor element without the need for human interaction upon extension of the ladder from the collapsed storage configuration to the extended use configuration. The fixation element may also be configured to be manually attached to the anchor element with the need for human interaction. In embodiments, the fixation element is configured to automatically attach to the anchor element upon extension of the ladder, while also allowing manual attachment of the fixation element to the anchor point if need be. This allows the fixation element to attach to the anchor element with a minimum of human interaction, while allowing the fixation element to be manually attached if for some reason it did not attach automatically. Accordingly, the speed and convenience of extending the ladder to the extended use configuration is increased while preserving the adaptability offered by manual attachment.

In embodiments, the system further comprises a first extension control mechanism configured to decelerate the ladder during at least part of the extension of the ladder from the collapsed storage configuration to the extended use configuration. The first extension control mechanism accordingly allows for slowing down the process of extending the ladder. The relatively slow extension of the ladder may improve safety as it allows more time to move out of the path of the extending ladder. The relatively slow extension may also decrease the amount of wear incurred by the ladder during extension. The deceleration may be effectuated, e.g., by mechanical damping in some or all joints connecting displaceable ladder segments, or one or more wires secured to the building as well as one or more ladder segments, the one or more wires being configured to extend in a damped manner.

In embodiments, the first extension control mechanism comprises a wire wound up on a wire drum when the ladder is in the collapsed storage configuration. The wire is connected at a proximal end, possibly via the wire drum, to the building. At a distal end, the wire is connected to a displaceable ladder segment of the ladder. In one embodiment, the distal end of the wire is connected to the most distal one of the displaceable ladder segments for a completely controlled extension of the ladder. The wire may be a metal wire, preferentially a steel wire for increased resilience towards elevated temperatures experienced during a fire. The wire drum may be passively or actively damped. The wire drum may be mechanically linked to an air break, like those found, e.g., on rowing machines, for damping. Alternatively or additionally, the wire drum may be connected to an electric motor for damping.

In embodiments, the first extension control mechanism is configured to sequentially extend the ladder segments one after another for increased control of extension of the displaceable ladder segments. In case the fixation extension mechanism is configured to automatically extend the at least one fixation element at a predetermined degree of displacement of adjacent ladder segments, this allows for timing of sequential extension of each fixation element as it is in the vicinity of an anchor element.

In embodiments, the fixation element and the anchor element are configured to be mutually detachable. In this case the ladder is detachable from the anchor element and is allowed to be removed from the anchor element for reuse. In one embodiment, the ladder is collapsible between the extended use configuration and the collapsed storage configuration. In one embodiment, the ladder is configured to sequentially collapse one ladder segment after another. In this case, the ladder is allowed to be detached from the anchor element and collapsed to the collapsed storage configuration after use.

In embodiments, the escape system further comprises a collapsing mechanism configured to automatically collapse the ladder from the extended use configuration to the collapsed storage configuration allowing convenient collapsing of the ladder for possible reuse.

In embodiments, the first extension control mechanism is also configured to retract the ladder from the extended use configuration towards the collapsed storage configuration. This allow for a simple and accordingly more robust construction of the escape system. In one embodiment, the fixation extension mechanism is also configured to automatically retract each fixation element as the first extension mechanism retracts the ladder allowing convenient retraction of the ladder for possible reuse. In one embodiment, the fixation extension mechanism is configured to automatically retract the at least one fixation element at a second predetermined degree of displacement of adjacent ladder segments for reliable detaching of fixation elements.

In embodiments, the proximal end of the ladder is secured to at least a part of the roof construction of the building, and the anchor element is secured to the façade of the building. In this case, the ladder is allowed to be secured to the building and being stored in the collapsed storage configuration at the roof of the building with minimised impact on the visual appearance of the building. Thanks to the anchor element being secured to the façade of the building, the ladder is allowed to be stabilised relative to the façade of the building even though the proximal end of the ladder may be only secured to the roof of the building.

In embodiments, the system comprises a plurality of anchor elements, wherein the ladder comprises a plurality of fixation elements. The addition of further anchor elements and fixation elements further increases the structural stability of the ladder and its immobility relative to the building in the extended use configuration.

In embodiments, the system comprises at least one anchor element secured to the façade of the building per floor of the building, wherein the ladder comprises at least one fixation element for each floor of the building. In this case, the structural stability of the ladder is allowed to remain intact with the addition of more floors to be spanned across in the extended use configuration. In one embodiment, each anchor element is arranged in the vicinity of a window. This both allows for optimum structural stability of the ladder in the vicinity of the window where people are expected to climb onto the ladder, while also allowing a person at the window to reach the fixation element and possibly manually attach it to the anchor element.

In embodiments, the proximal end of the ladder is secured to at least one rafter of the roof construction for improved integrity of the securement of the ladder to the roof. Securement to at least one rafter further allows the ladder to be secured and possibly stored below the visual roofing. In one embodiment, the proximal end of the ladder is secured between at least two rafters of the roof construction and is covered by the roofing. This allows for an even more hidden collapsed storage configuration of the ladder. In one embodiment, an opening, possibly latched, in the eave or fascia of the building is arranged to allow the ladder to be extended through the opening. This allows for efficient operation of extension of the ladder with a minimum of impact on the appearance and visual expression of the building.

In embodiments, the proximal end of the ladder comprises a second spacer element extending between the part of the ladder secured to at least a part of the roof construction of the building and the remaining essentially rigid ladder segments of the ladder. This allows for providing a space between the ladder and the façade of the building near the roof of the building. It may further allow a constant distance between the ladder and the façade of the building from the roof and down. This may further improve the structural stability of the ladder and the ability of a person to climb the ladder in the space between the ladder and the façade of the building.

The escape system may further comprise a displaceable securing element securing the proximal end of the ladder to at least part of the roof construction of the building, the displaceable securing element being displaceable between a storage configuration retracted from the edge of the roof and an extended use configuration towards the edge of the roof. This allows the ladder to be stored in the collapsed storage configuration retracted from the edge of the roof in a less visible manner, while also allowing the ladder to be extended at a more optimum site towards the edge of the roof. In one embodiment, the displaceable securing element comprises the second spacer element for increased stability of the ladder and convenience for ladder users. In one embodiment, the connection between the proximal end of the ladder and the displaceable securing element is configured to extend the ladder above the edge of the roof in the extended use configuration for ease of access to the ladder from the roof of the building.

In embodiments, a second extension control mechanism allows extension of the ladder in a first stage by application of a first force, and extension in a second stage by application of a second force, wherein the second force is greater than the first force. The differentiated resistance of the ladder towards extension allows for a rapid extension during the first stage for rapid extension of the ladder, while the greater second force required for the second stage allows for more controlled extension of the ladder during the second stage.

In embodiments, extension during the second stage corresponds to a length extension of at least two metre. In this case a person below the ladder with a height below two meter may have an increased chance of avoiding the extending ladder from above during the more controlled second stage extension. In one embodiment, extension during the second stage corresponds to a length of three meters. In this case, the ladder is allowed to be slowed down prior to reaching the space above ground commonly occupied by people.

In embodiments, a distal end of the ladder opposite the proximal end of the ladder in the extended use configuration comprises support means, the support means being configured to engage a surface beneath the ladder when the ladder is in the extended use configuration.

The support means allow further improvement of the structural stability of the ladder. The support means may further be attachable to ground providing a further improvement of the structural stability of the ladder. In one embodiment, the support means are configured to detachably attach to support attachment means secured to the surface beneath the ladder. In this case, the structural stability of the ladder in the extended use configuration may be increased, while also allowing the ladder to be collapsed from the extended use configuration to the collapsed storage configuration.

In a further aspect, the invention provides an escape system for providing an escape route out of a building, the system comprising a ladder securable at a proximal end thereof to a building, and at least one anchor element at a fixed position relative to the building at a position distant from the proximal end of the ladder, the ladder being extendible between a collapsed storage configuration and an extended use configuration, wherein the ladder comprises:

a plurality of essentially rigid ladder segments, each ladder segment comprising at least one rung and being telescopically displaceable in relation to the remaining plurality of ladder segments;

a stopping mechanism configured to prevent ladder segments from displacement beyond its extension in the extended use configuration; and at least one fixation element attached to or forming part of at least one of the ladder segments, the fixation element comprising a first spacer element, the first spacer element extending between the anchor element and the ladder in the extended use configuration, wherein the ladder is detached from the anchor element in the collapsed storage configuration, and at least one fixation element of the ladder is configured to attach to the anchor element when the ladder is in the extended use configuration.

In yet a further aspect, the invention provides an escape ladder for being mounted on a building, the ladder being securable at a proximal end thereof to a building and being extendible between a collapsed storage configuration and an extended use configuration, wherein the ladder comprises:

a plurality of essentially rigid ladder segments, each ladder segment comprising at least one rung and being telescopically displaceable in relation to the remaining plurality of ladder segments;

a stopping mechanism configured to prevent ladder segments from displacement beyond its extension in the extended use configuration; and at least one fixation element attached to or forming part of at least one of the ladder segments, the fixation element comprising a first spacer element, the first spacer element extending between the building and the ladder in the extended use configuration, wherein at least one fixation element of the ladder is configured to attach to an anchor element when the ladder is in the extended use configuration.

DESCRIPTION OF THE DRAWINGS

Embodiments of the invention will now be further described with reference to the drawings, wherein:

FIG. 1 illustrates: an escape system 100 according to an embodiment of the invention. The escape system 100 comprises a ladder 102 secured at a proximal end 104 to the roof 106 of a building. In FIG. 1, the ladder 102 is in an extended use configuration spanning the façade 108 of the building from the roof 106 and down. The ladder comprises a plurality of telescopically displaceable rigid ladder segments 110 that each comprises one rung. A stopping mechanism 111, see FIG. 14 or FIG. 24, is preventing the ladder from further extension beyond the extended use configuration. The stopping mechanism is in the form of protrusion on adjacent ladder segments. At the inside of the tube 112 of outer one of the adjacent ladder segments 110 is a spring loaded protrusion, while a corresponding spring loaded protrusion on the outside of the tube 112 of an inner one of the adjacent ladder segments 110, and the two spring loaded protrusions are arranged to interlock when the adjacent ladder segments 110 have been extended, and to be collapsed in the collapsed storage configuration.

Figure 1:
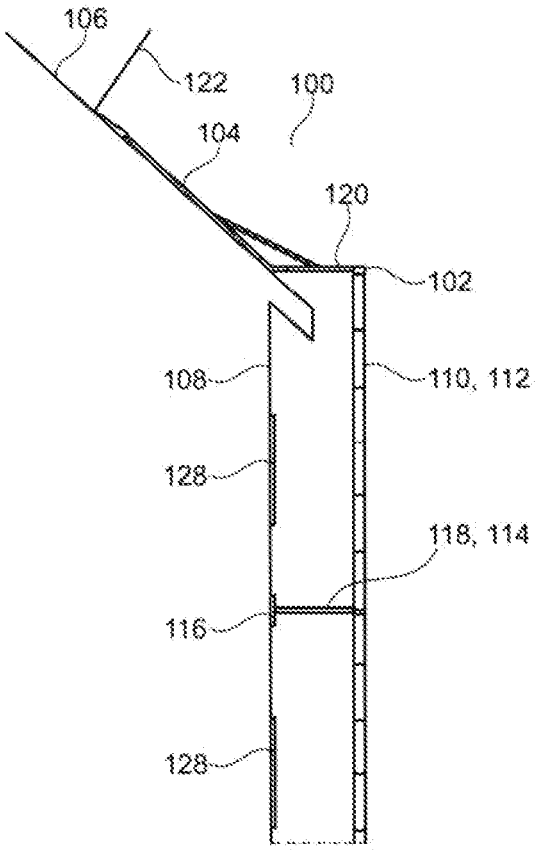
FIG. 1 and FIGS. 9-12 illustrate an escape system according to embodiments of the invention.

A fixation element 114 of the ladder 102 attached to a ladder segment 110 is detachably attached to an anchor element 116 on the façade 108 of the building providing structural stability for the ladder 102. A first spacer element 118 of the fixation element 114 extends between the façade 108 and the ladder 102 providing a space between the two for a person to climb the ladder 102. In the embodiment of FIG. 1, the proximal end 104 of the ladder 102 comprises a second spacer element 120 extending between the part of the ladder 102 secured to the roof 106 of the building and the remaining essentially rigid ladder segments 110. This allows for providing a space between the ladder 102 and the façade 108 of the building near the roof 106 and a constant distance between the ladder 102 and the façade 108 of the building from the roof 106 and down.

Also visible in FIG. 1 is an open lid 122 of a housing 124 for storing the ladder 102 in the collapsed storage configuration.

Figure 2:
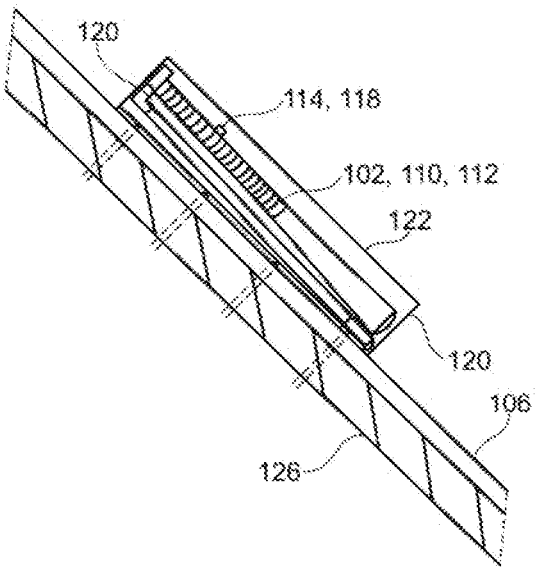
FIGS. 2-8 and FIGS. 13-28 illustrate parts of an escape system according to embodiments of the invention.

In FIG. 2, the ladder 102 is stored in the housing 124 in the collapsed storage configuration. The housing 124 and ladder 102 is secured through the roofing of the building to a rafter 126 of the roof construction. In the collapsed storage configuration, the ladder segments 110 are compressed and the fixation element 114 and second spacer element 120 are folded up for storage.

Figure 3:
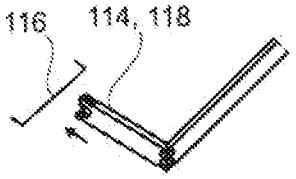
Figure 4:
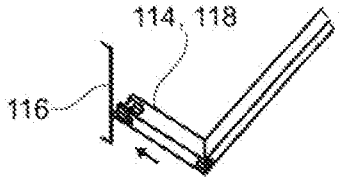
Figure 5:
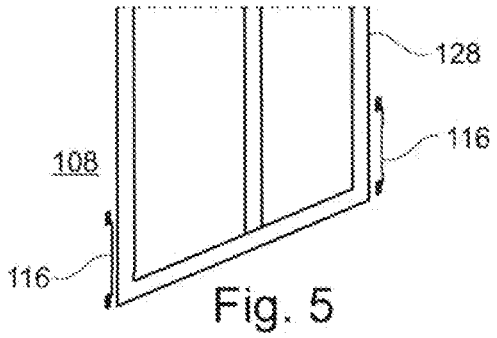
Figure 6:
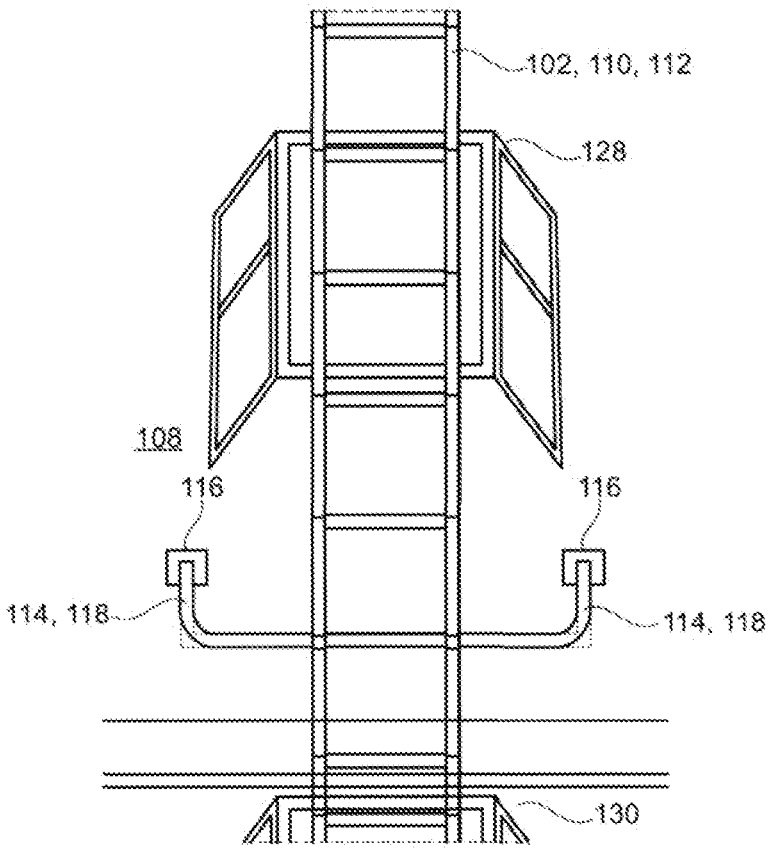

In FIGS. 3-5, embodiments of the fixation element 114 and anchor element 116 are illustrated. In the embodiment of FIG. 3, the anchor element 116 is oriented horizontally relative to the building, and the fixation element 114 is configured to detachably attach to the horizontal anchor element 116. In this configuration, attachment of the fixation element 114 to the anchor element 116 is particularly tolerant towards horizontal displacement of the ladder 102 relative to the building, while vertical movement of the ladder 102 is restricted. In this way, the attachment is able to carry a load. In FIG. 4, the anchor element 114 is oriented vertically relative to the building, and the fixation element 114 is configured to detachably attach to the vertical anchor element 116. The embodiment of FIG. 4 is accordingly particularly tolerant towards vertical displacement of the ladder 102 relative to the building. Vertical tolerance may be particularly important as manual vertical displacement of the ladder 102 for manual attachment is expectedly considerably more difficult than horizontal displacement of the ladder 102. FIG. 5 illustrates the vertically oriented anchor elements 116 secured to the façade 108 of the building in the vicinity of a window 128 for easy of manual attachment and improved structural stability in the vicinity of the window 128. See FIG. 6 for another embodiment with the ladder 102 in the extended use configuration spanning a window 128 of the building.

Figure 7:
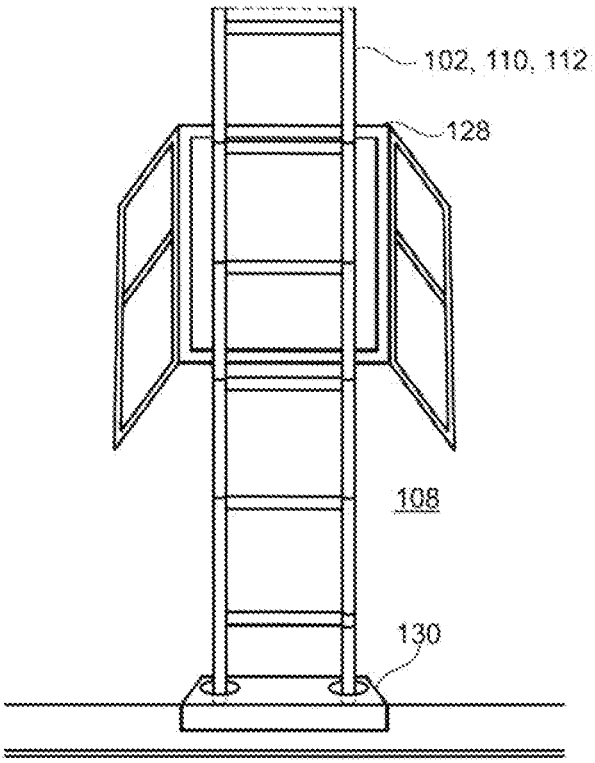
Figure 8:
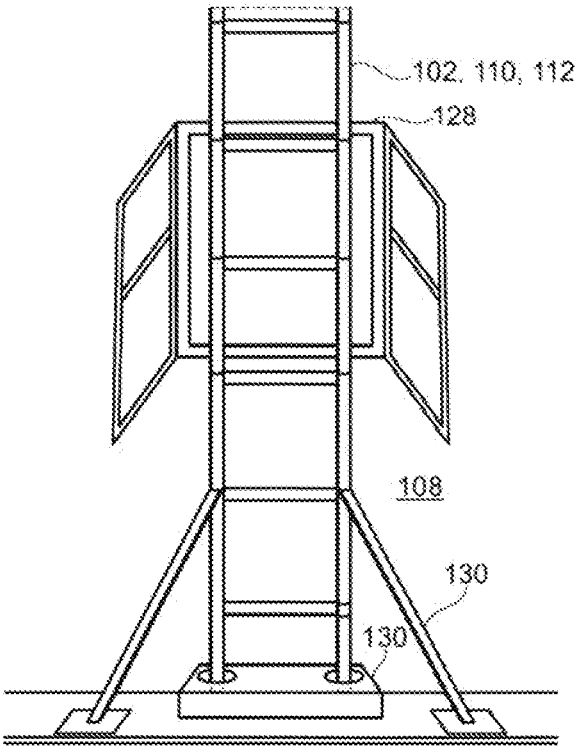

FIGS. 7 and 8 illustrate alternative embodiments of the escape system 100, wherein a distal end of the ladder opposite the proximal end of the ladder in the extended use configuration comprises support means 130. The support means 130 are engaged with the surface beneath the ladder 102 when the ladder 102 is in the extended use configuration. The support means 130 of FIG. 7 allows for a more compact collapsed storage configuration, while the support means 130 if FIG. 8 provide improved stability of the contact between the ladder 102 and surface.

In one embodiment, a second extension control mechanism allows extension of the ladder 102 in a first stage by application of a first force, and extension in a second stage by application of a second force, wherein the second force is greater than the first force. This is facilitated by a relatively high coefficient of friction between the tubes 112 of the nine adjacent ladder segments 110 closest to ground. This relatively high coefficient of friction causes the last eight ladder segments 110 closest to ground to extend relative slowly for a controlled decent during the last 3 meters.

Figure 9:
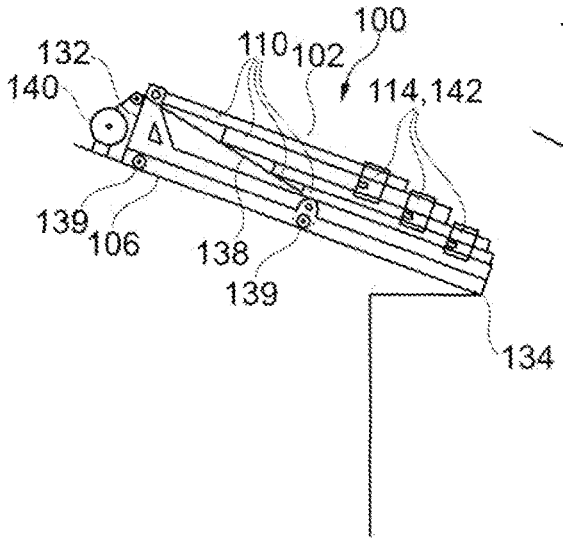

FIGS. 9-12 illustrate an escape system 100 according to an embodiment of the invention at various degrees of extension. The illustrated embodied escape system 100 comprises a displaceable securing element 132 secured to part of the roof construction 106 of a building. In FIG. 9 the displaceable securing element is in a storage configuration retracted from the edge 134 of the roof 106 housing the ladder 102 in its collapsed storage configuration. The embodied escape system 100 further comprises a first extension control mechanism 136 in the form of a wire 138, e.g., made of steel secured to a wire drum 140, which in turn is secured to the roof construction 106. When the escape system 100 is activated, the break of the wire drum 136 is released and the displaceable securing element 132 is pulled by gravity towards the edge 134 of the roof 106 while being damped by the wire 138 and wire drum 140. The displaceable securing element 132 is allowed to roll on rollers 139 mounted below it.

Figure 10:
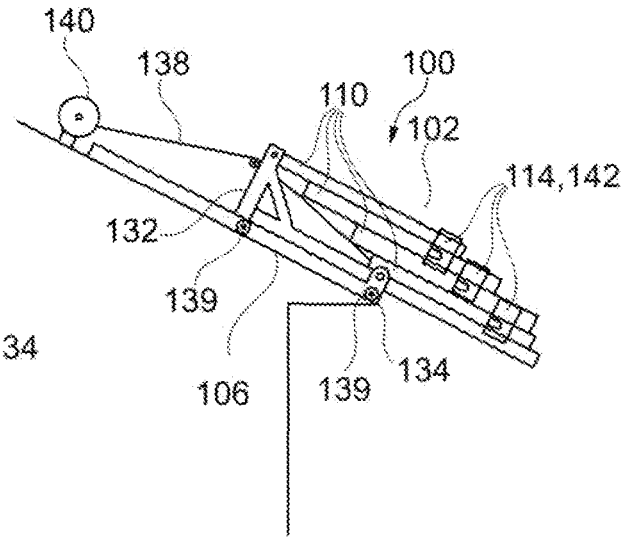
Figure 11:
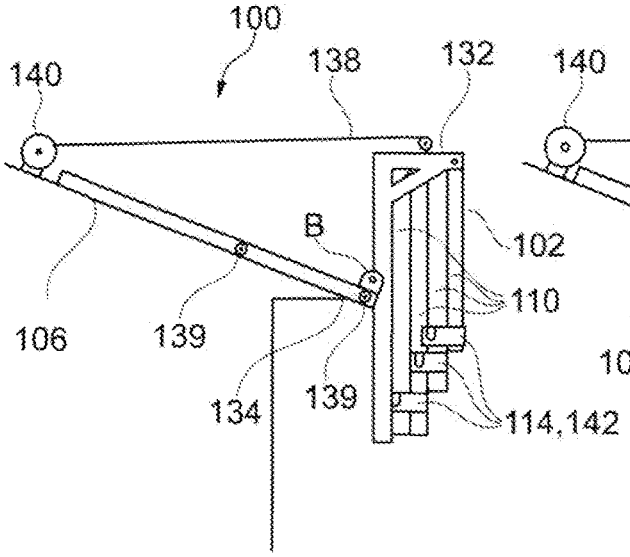
Figure 12:
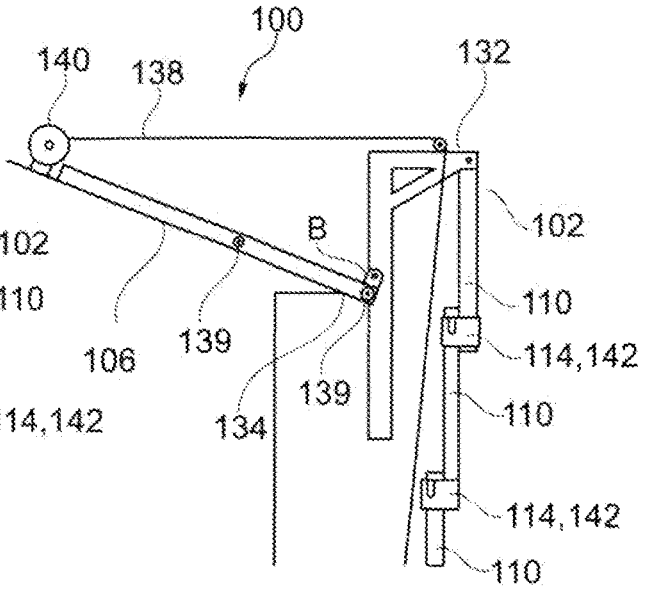

In FIG. 10, the displaceable securing element 132 has reached the edge 134 and the ladder 102 still in the collapsed storage configuration is partially suspended over the edge 134 of the roof 106. The gravitational pull on the suspended part of the ladder 102 causes the ladder 102 and displaceable securing element 132 to rotate towards a vertical configuration as illustrated in FIG. 11. A joint 142 of the displaceable securing element 132 prevents further rotation. Thereafter the gravitational pull sequentially extends the displaceable ladder segments 110 as illustrated in FIG. 12. The sequential extension is enabled by the dampening caused by the wire 138 connected to the ladder segment 110 furthest from the roof in the extended use configuration.

Figure 13:
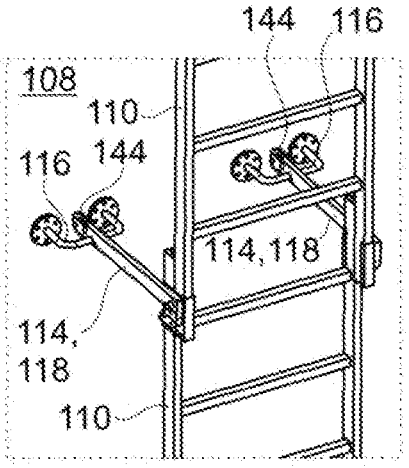
Figure 14:
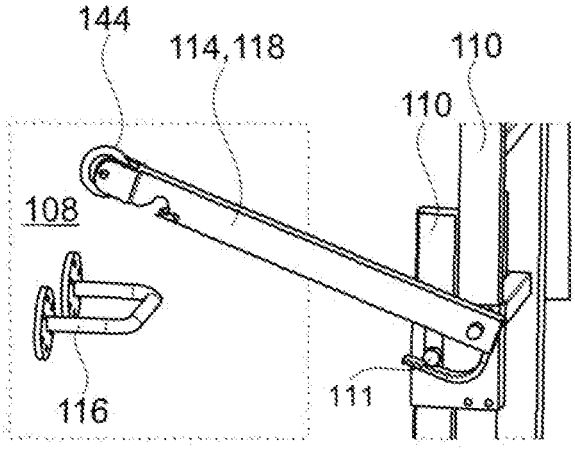
Figure 15:
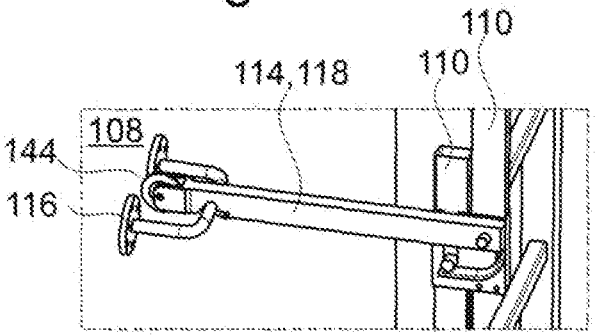

In the embodiment of FIGS. 13-15 the ladder comprises a plurality of rigid ladder segments 110 being displaceable relative to each other in parallel planes.

FIGS. 13-15 illustrate an embodiment of a fixation element 114 and anchor element 116. In this embodiment, the anchor element 116 is secured to the façade 108. The fixation element 116 comprises a wheel 144 allowing the proximal end 146 to roll along the façade 108 for achieving attachment to the anchor element 116 while pushing the ladder 102 away from the façade 108. The fixation element 114 further comprises a resilient connection member 146 for achieving resilient, detachable attachment between the fixation element 114 and anchor element 116.

Figure 16:
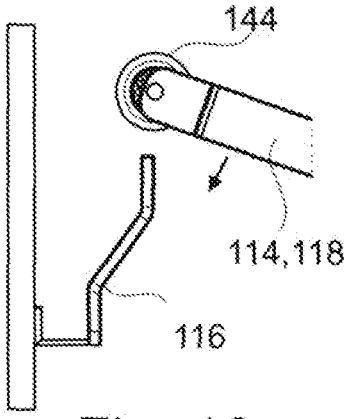
Figure 17:
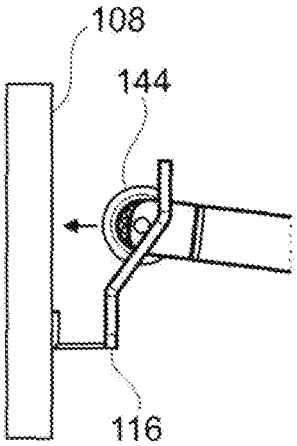
Figure 18:
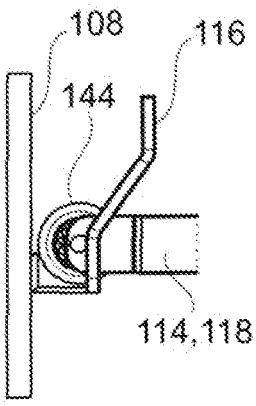

FIGS. 16-18 illustrate another embodiment of a fixation element 114 and anchor element 116. In this embodiment, the shape of the anchor element 116 allows the fixation element 114 and thereby also the ladder 102 to be pulled towards the façade 108 as the fixation element 114 attaches to the anchor element 114.

Figure 19:
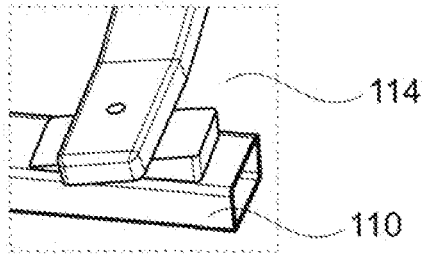
Figure 20:
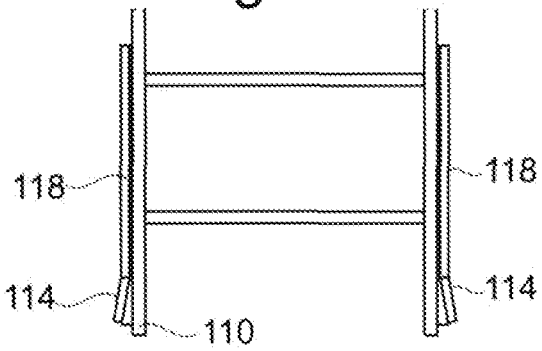
Figure 21:
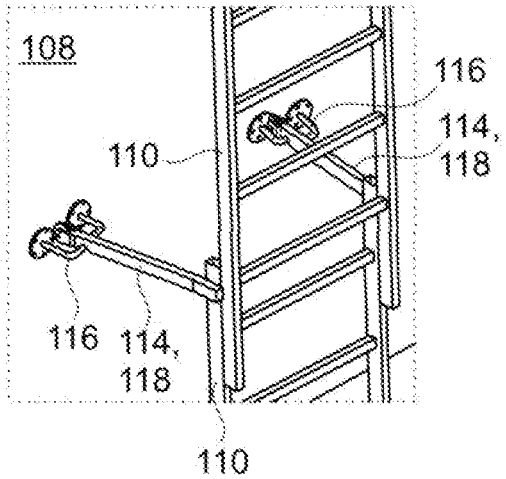

FIGS. 19-21 illustrate yet another set of fixation element 114 and anchor element 116. In this embodiment, the fixation elements 114 are configured to extend towards the anchor elements 116 at angle not being normal to the façade 108 of the building. As illustrated in FIG. 21, the anchor elements 116 are spaced further apart than the ladder 102 is wide. When the fixation elements 114 are attached to the anchor elements 116 this provides a relatively high degree of structural stability as well as a relatively large amount of space for a person to climb in between the façade 108, the ladder segments 110 and the fixation elements 114.

Figure 22:
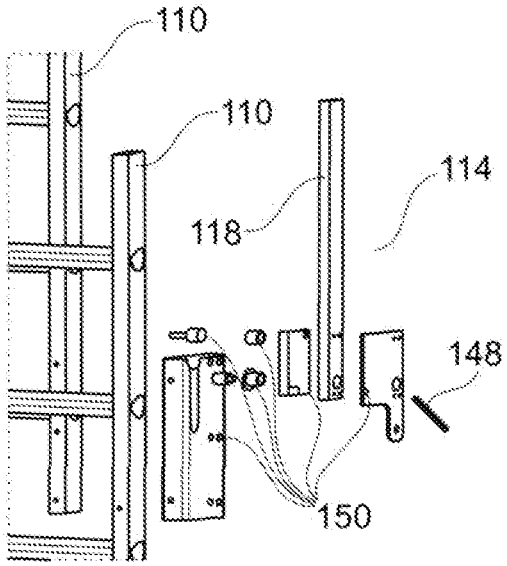

FIG. 22 illustrates the details of on embodied fixation element 114. The workings of the fixation element of FIG. 22 are illustrated in FIGS. 23-28. In FIG. 22 two adjacent ladder segments 110 are illustrated. These ladder segments 110 are connected by the fixation element 114 in manner allowing them to be displaced in parallel planes. The fixation element 114 comprises a first spacer element 118, a spring 148, as well as other mechanical components 150. The spring 148 allows the spacer element 118 to resiliently extend towards the façade 108 of the building.

Figure 23:
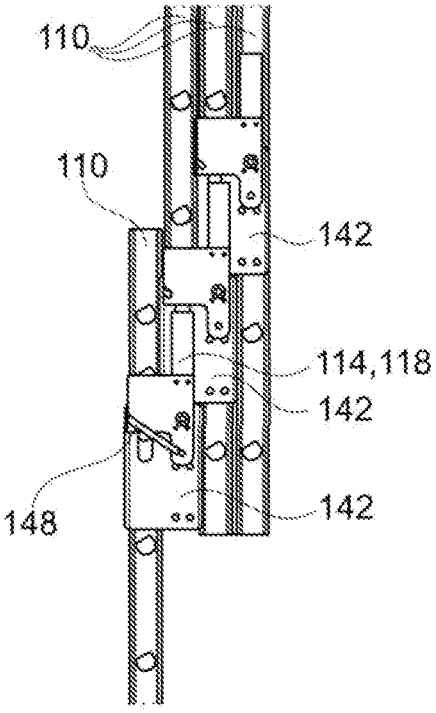

FIG. 23 illustrates that the fixation element 114 connects adjacent ladder segments 110 in a slideably, displaceable manner.

Figure 24:
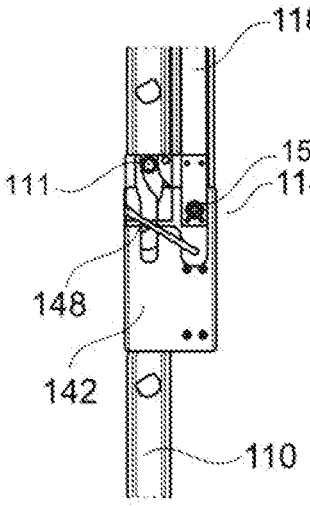
Figure 25:
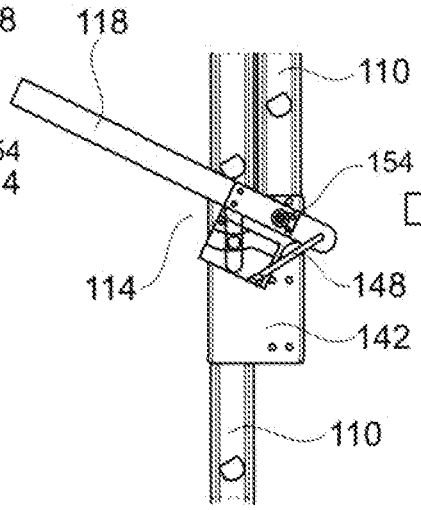
Figure 26:
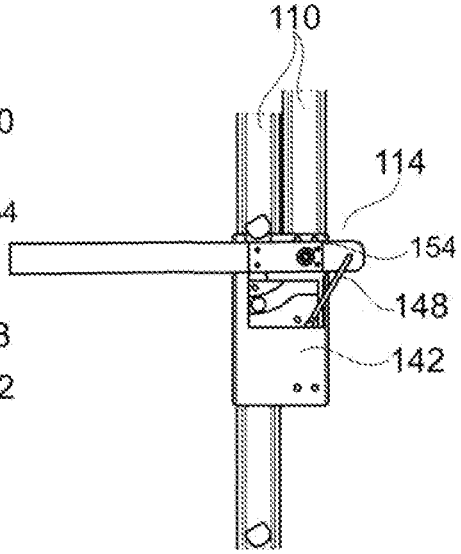

FIGS. 24-26 illustrate unobstructed automatic extension of the fixation element 114. In FIG. 24 two adjacent ladder segments 110 are extended to a degree less than a first predetermined degree of displacement. In FIG. 25 the first predetermined degree of displacement has been reached in the first spacer element 118 is automatically extended towards the façade 108. In FIG. 26 the first spacer element 118 is fully extended and the adjacent ladder segments 110 have reached their maximum allowed degree of displacement.

Figure 27:
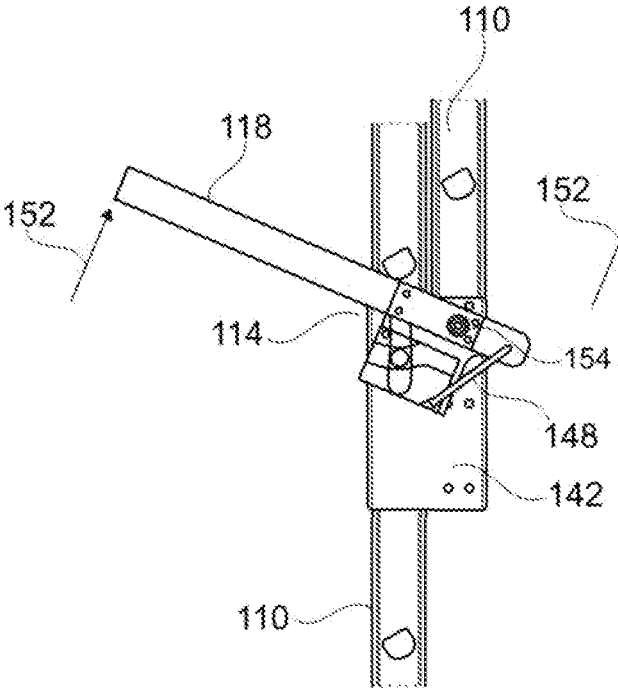
Figure 28:
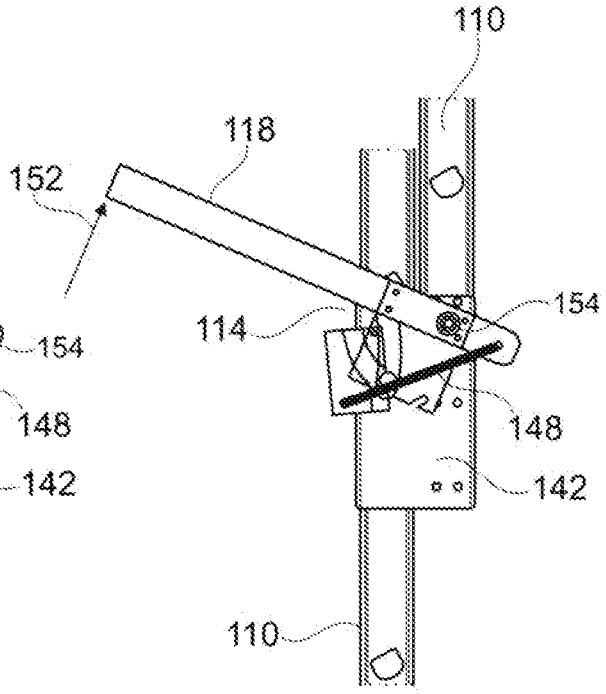

FIGS. 27-28 illustrate displacement of the adjacent ladder segments 110 in case of obstructed extension of the fixation element 114. In FIG. 27 the adjacent ladder segments 110 have been displaced beyond the first predetermined degree of displacement and the fixation element 114 is being automatically extended towards the façade 108 as a result thereof. At the instance depicted in FIG. 27 the extension of the fixation element 114 is being obstructed by an object exerting a force on the first spacer element 118 as illustrated by the arrow 152. Further displacement of the adjacent ladder segments 110 do not cause further extension of the first spacer element 118 while it is being obstructed by the object. Rather, further displacement causes the spring 148 to be loaded. The resilience provided by the loaded spring 148 would subsequently fully extend the first spacer element 118 and fixation element 114 if the object was removed. FIGS. 24-28 also show a collapsing mechanism 154 which is configured to automatically collapse the ladder from the extended use configuration to the collapsed storage configuration allowing convenient collapsing of the ladder for possible reuse.

The invention claimed is:

1. An escape system for providing an escape route out of a building, the system comprising a ladder securable at a proximal end thereof to said building, and at least one anchor element at a fixed position relative to the building at a position distant from the proximal end of the ladder, the ladder being extendible between a collapsed storage configuration and an extended use configuration, wherein the ladder comprises:

Plurality of essentially rigid ladder segments, each the ladder segments comprising at least one rung and being displaceable in relation to a remaining plurality of ladder segments of the plurality of essentially rigid ladder segments;

a stopping mechanism configured to prevent the ladder segments from displacement beyond extension in the extended use configuration; and at least one fixation element attached to or forming part of at least one of the ladder segments, the at least one fixation element comprising a first spacer element, the first spacer element extending between the anchor element and the ladder in the extended use configuration, and a fixation extension mechanism configured to automatically extend the at least one fixation element towards the anchor element when the ladder is extended from the collapsed storage configuration to the extended use configuration, wherein the fixation extension mechanism comprises a resilient member allowing the fixation element to be resiliently extended towards the anchor element, wherein the ladder is detached from the anchor element in the collapsed storage configuration, and the at least one fixation element of the ladder is configured to attach to the anchor element when the ladder is in the extended use configuration.

2. The storage system according to claim 1, wherein each of the ladder segments is telescopically displaceable in relation to the remaining plurality of ladder Segments.

3. The escape system according to claim 1, further comprising a first extension control mechanism configured to decelerate the ladder during at least part of the extension of the ladder from the collapsed storage configuration to the extended use configuration.

4. The escape system according claim 3, wherein the first extension control mechanism configured to sequentially extend the ladder segments one after another.

5. The escape System according to claim 1, wherein the fixation element and the anchor element are configured to be mutually detachable.

6. The escape system according to claim 5, further comprising a collapsing mechanism constructed and arranged to collapse the ladder from the extended use configuration to the collapsed storage configuration.

7. The escape system according to claim 1, wherein the proximal end of the ladder is configured for being secured to at least a part of a roof construction of the building, and the anchor element is configured for being secured to a façade of the building.

8. The escape system according to claim 7, wherein the at least one anchor element is a plurality of anchor elements, and wherein the at least one fixation element is a plurality of fixation elements.

9. The escape system according to claim 7, wherein the proximal end of the ladder is configured for being secured to at least one rafter of the roof construction.

10. The escape system according to claim 8, wherein the proximal end of the ladder is configured for being secured to at least one rafter of the roof construction.

11. The escape system according to claim 1, wherein the proximal end of the ladder comprises a second spacer element extending between a part of the ladder secured to at least a part of a roof construction of the building and the remaining plurality of ladder segments.

12. The escape system according to claim 1, wherein a second extension control mechanism allows extension of the ladder in a first stage by application of a first force, and extension in a second stage by application of a second force, and wherein the second force is greater than the first force.

13. An escape ladder for being mounting on a building, the ladder being securable at a proximal end thereof to the building and being extendible between a collapsed storage configuration and at extended use configuration, wherein the ladder comprises:

a plurality of essentially rigid ladder segments, each of the ladder segments comprising at least one rung and being displaceable in relation to a remaining plurality of ladder segments of the plurality of essentially rigid ladder segments;

a stopping mechanism configured to prevent the ladder segments from displacement beyond extension in the extended use configuration; and at least one fixation attached to or forming part of at least one of the ladder segments, the fixation element comprising a first spacer element, the first spacer element extending between the building and the ladder in the extended use configuration, and a fixation extension mechanism configured to automatically extend the at least one fixation element towards an anchor element when the ladder is extended from the collapsed storage configuration to the extended use configuration, wherein the fixation extension mechanism comprises a resilient member allowing the fixation element to be resiliently extended towards the anchor element, wherein the at least one fixation element of the ladder is configured to attach to the anchor element when the ladder is in the extended use configuration.

* * * * *